US009976772B2

(12) United States Patent
Van Der Klis et al.

(10) Patent No.: US 9,976,772 B2
(45) Date of Patent: May 22, 2018

(54) SECTIONAL HEAT EXCHANGER FOR USE IN A HEAT CELL

(71) Applicant: BEKAERT COMBUSTION TECHNOLOGY B.V., Assen (NL)

(72) Inventors: Josephine Van Der Klis, Helmond (NL); Omke Jan Teerling, 't Harde (NL)

(73) Assignee: BEKAERT COMBUSTION TECHNOLOGY B.V., Assen (NL)

( * ) Notice: Subject to any disclaimer, the term of this patent is extended or adjusted under 35 U.S.C. 154(b) by 33 days.

(21) Appl. No.: 14/903,721

(22) PCT Filed: Jul. 15, 2014

(86) PCT No.: PCT/EP2014/065135
§ 371 (c)(1),
(2) Date: Jan. 8, 2016

(87) PCT Pub. No.: WO2015/024712
PCT Pub. Date: Feb. 26, 2015

(65) Prior Publication Data

US 2016/0161144 A1 Jun. 9, 2016

(30) Foreign Application Priority Data

Aug. 20, 2013 (EP) ..... 13180952

(51) Int. Cl.
*F24H 1/32* (2006.01)
*F24H 9/00* (2006.01)

(52) U.S. Cl.
CPC ..... *F24H 1/32* (2013.01); *F24H 9/0015* (2013.01); *F24H 9/0026* (2013.01)

(58) Field of Classification Search
CPC ..... F24H 1/32; F24H 9/0026
(Continued)

(56) References Cited

U.S. PATENT DOCUMENTS 1,700,104 A 1/1929 Williams
3,533,379 A 10/1970 Martin et al.
4,852,523 A * 8/1989 Zeimes ..... F24H 1/287 122/156

FOREIGN PATENT DOCUMENTS

DE 102005014616 B3 6/2006
EP 0843135 A1 5/1998
(Continued)

OTHER PUBLICATIONS

International Search Report (ISR) dated Oct. 28, 2014, for PCT/EP2014/065135.

*Primary Examiner* — Alissa Tompkins
*Assistant Examiner* — John Bargero
(74) *Attorney, Agent, or Firm* — Bacon & Thomas, PLLC

(57) ABSTRACT

A sectional heat exchanger for a heat cell. The sectional heat exchanger having two end segments and one or more intermediate segment(s) provided between the two end segments which are assembled in the heat exchanger. A combustion chamber is provided in the sectional heat exchanger, perpendicular to the one or more intermediate segment(s), each of the one or more intermediate segments having at least one flow channel for a fluid to be heated. In between each two consecutive segments at least one flow channel for flue gas is present. The total width of the sectional heat exchanger decreases over at least part of the length in the direction away from the combustion chamber. The depth of the flow channels for flue gas decreases in the direction away from the combustion chamber. The distance between the two walls delimiting the intermediate segment increases in the direction away from the combustion chamber.

12 Claims, 3 Drawing Sheets

(58) Field of Classification Search
USPC ..... 122/18.31
See application file for complete search history.

(56) References Cited

FOREIGN PATENT DOCUMENTS

| | | | |
|---|---|---|---|
| EP | 2080961 | A2 | 7/2009 |
| EP | 2213958 | A2 | 8/2010 |
| WO | 2008/004855 | A2 | 1/2008 |
| WO | 2010/037719 | A2 | 4/2010 |

* cited by examiner

SECTIONAL HEAT EXCHANGER FOR USE IN A HEAT CELL

The invention relates to the field of sectional heat exchangers for use in a heat cell. Such heat exchangers consist of several sections. When assembling the sectional heat exchanger, the number of sections is selected as a function of the capacity of the sectional heat exchanger. More specifically, the sectional heat exchanger of the invention has a combustion chamber in which a burner can be installed (thereby forming a heat cell) for the generation of flue gas that will transfer its thermal energy to heat a liquid. Such heat cells can be used in boilers.

BACKGROUND ART

Sectional heat exchangers are built up of a number of sections or segments. Sectional heat exchangers, e.g. in aluminium, exist that comprise a number of identical intermediate segments positioned next to each other; and two end segments. The number of intermediate segments that is used in the assembly of the heat exchanger depends on the required capacity of the heat exchanger. The heat exchanger has a number of channels (at least one water channel in each intermediate segment) in parallel flow connection for water to be heated, and flue gas channels extending from the one or more combustion chambers in the heat exchanger.

Examples of such heat exchangers can be found in DE102005014616B3, EP0843135A1 and WO2008/004855A2.

EP0843135A1 discloses a sectional heat exchanger wherein individual combustion chambers are created between each two segments of the sectional heat exchanger. Each combustion chamber is provided with one or more separate burners.

The segments of WO2008/004855A2 are assembled creating a heat exchanger with one combustion chamber, and with an individual burner for each intermediate segment, in order to produce flue gas for heat exchange with water flowing through the water channels of the sectional heat exchanger. The intermediate segments are assembled parallel to each other. The intermediate segments of WO2008/004855A2 can be made using extruded profiles.

A sectional heat exchanger, using cast intermediate segments, is provided in DE102005014616B3, in which one single burner can be used, mounted in the one combustion chamber of the sectional heat exchanger.

EP2080961A2 describes a boiler having a sectional heat exchanger. The sectional heat exchanger has vertical elements made of casting material for gas or oil combustion for heat exchange between hot gases and boiler water. An exhaust gas- and condensation water collector is formed in a lower area, and a combustion chamber is separated from a circular water arm. Vertical water arms are fastened to the circular water arm at water side below the combustion chamber based on a lower hub. The vertical water arms form a vertical flow channel for the hot gases.

U.S. Pat. No. 3,533,379A discloses a section boiler having grooved or channeled spaces at the interface of adjacent sections. A pliable elastic sealant, which remains substantially permanently pliable and elastic, fits the grooved or channeled spaces to join the sections. The joinder so formed is leak-proof at all ambient temperatures and flue pressures, including the flue pressures encountered in forced draft boiler systems.

It is a problem of the sectional heat exchangers of the prior art that the performance and efficiency is not optimal.

SUMMARY OF THE INVENTION

The primary object of the invention is to provide sectional heat exchangers for heat cells that have higher performance and that are easy to assemble.

A first aspect of the invention is a sectional heat exchanger as described in claim 1.

A first aspect of the invention is a sectional heat exchanger for a heat cell. The sectional heat exchanger comprises two end segments and one or more intermediate segment(s) provided between the two end segments. Preferably, the two end segments and the one or more intermediate segment(s) are assembled parallel to each other. When designing and assembling the heat exchanger, the number of intermediate segments can be selected to set the capacity of the heat exchanger.

The one or more intermediate segment(s) and the two end segments are assembled in the heat exchanger, wherein a combustion chamber is provided in the sectional heat exchanger, perpendicular to the one or more intermediate segment(s). Preferably the combustion chamber is foreseen for installation of a burner, preferably for installation of one, and more preferably for only one, burner. Preferably, the combustion chamber is beam shaped with a straight linear axis through the one or more intermediate segments, with a constant cross section through the intermediate segments of the sectional heat exchanger.

Each of the one or more intermediate segment(s), and preferably also the end segments, comprises at least one flow channel for a fluid (e.g. water) to be heated.

If more than one intermediate segment is present, in between each two consecutive intermediate segments at least one flow channel for flue gas is present, wherein the flow channel extends from at the combustion chamber. Preferably, between an end segment and an intermediate segment, and between two intermediate segments if more than one intermediate segment is present, at least one flow channel for flue gas is present extending from at the combustion chamber. Preferably, in between each two consecutive segments at least one flow channel for flue gas is present, and the flow channel extends from at the combustion chamber.

In between two segments, in the plane parallel with the one or more intermediate segment(s), the total width of the sectional heat exchanger decreases over at least part of the length in the direction away from the combustion chamber. Preferably, the total width decreases over at least half of the length—as measured perpendicularly to the combustion chamber—of the segments between which flue gas channels are present; more preferably over at least 75% of that length. Preferably the width decrease is a continuous decrease over the length over which it decreases. Such continuous decrease is beneficial as it facilitates the production of such segments. Preferably the ratio of the largest to the smallest width is smaller than 4, preferably larger than 1.5; more preferably smaller than 3. The width decrease implies a width decrease of the flue gas channels between two consecutive segments. Preferably the width decrease results in a width decrease of the flue gas channels between two consecutive segments, wherein the ratio of the largest to the smallest width is smaller than 4, preferably larger than 1.5; more preferably smaller than 3.

The depth of the flow channels for flue gas, measured perpendicularly to the one or more intermediate segment and between consecutive segments, decreases in the direction away from the combustion chamber. Preferably the depth decreases over at least half of the length in the sectional heat exchanger for flue gas flow away from the combustion chamber, more preferably over at least 75% of that length. Preferably the depth decrease is a continuous decrease over the length over which it decreases. Preferably the range of the largest over the smallest depth is larger than 2, preferably larger than 3 and preferably smaller than 4, more preferably smaller than 3.5. The ranges have a benefit, as when the sectional heat exchanger is standing (e.g. on a sump mounted at the flue gas exit of the heat exchanger), it is standing more stable.

In the one or more intermediate segment(s), the distance between the two walls delimiting the intermediate segment and which are in heat exchanging relation with flue gas channels formed between segments, increases in the direction away from the combustion chamber, thereby increasing the depth available for one or more fluid flow channels in the intermediate segment. Preferably this distance increases over at least half of the length away from the combustion chamber, more preferably over at least 75% of its length. Preferably the increase is a continuous increase over the length over which it increases.

The sectional heat exchanger of the invention has the benefit that it has increased energy efficiency, thanks to the synergistic beneficial effects of its structural features. The energy efficiency of a heat exchanger is determined on the one hand by the amount of heat exchange between flue gas and fluid, as determined by the amount of heat exchange surface and by the speeds of the flue gas and the fluid when using the heat exchanger. On the other hand, energy consumption by the system itself has to be taken into account, especially pump energy to force the fluid to be heated through the heat exchanger and energy to drive the fan to feed the burner in the combustion chamber. The invention allows building a more compact and lighter heat exchanger for the same capacity and performance, and with a same efficiency.

Preferably the one or more intermediate segments and/or the two end segments are aluminium or aluminium alloy segments, preferably separate segments.

Preferably the one or more intermediate segments and/or the two end segments are cast segments, preferably separate cast segments.

In a preferred embodiment, the sectional heat exchanger comprises at least two intermediate segments and the at least two intermediate segments are provided parallel to each other in the sectional heat exchanger.

Preferably, the ratio of the maximum to the minimum surface of the cross section of a flue gas channel—measured perpendicularly to the one or more intermediate segment(s)—in a same flue gas channel between consecutive segments is between 4 and 6, more preferably between 4.5 and 6, even more preferably between 5 and 6.

Preferably, at least part of the walls of the intermediate segments between the at least one channel for fluid to be heated and the flow channel for flue gas are provided with means to increase the heat transfer through the walls. Preferably, at least part of the walls of the end segments between a channel for fluid to be heated and the flow channel for flue gas between the end segment and an intermediate segment are provided with means to increase the heat transfer through the walls. Examples of such means are means extending from the wall into the flue gas channel, e.g. pins and/or fins that can e.g. be produced when casting the segments.

In a preferred embodiment, a fluid flow channel in an intermediate segment follows a meandering flow path. Preferably the meandering flow channels are substantially perpendicular to the direction of flue gas flow in the flue gas channels between segments when the heat exchanger is in use.

In a preferred embodiment, the height of at least part of the fluid flow channels in the end segments and/or in the intermediate segment(s) (e.g. of meandering flow channels in the intermediate segment) increases in the direction away from the combustion chamber over at least part of the height of the intermediate segment over which one or more fluid flow channels are present. With the height of the fluid flow channel is meant the dimension of the fluid flow channel in the average direction of flue gas flow when the heat exchanger is in use, away from the combustion chamber.

In a preferred embodiment, the sectional heat exchanger comprises more than one intermediate segment and fluid flow channels of the more than one intermediate segments, and preferably also of the two end segments, are connected in parallel flow connection.

In a preferred embodiment wherein the sectional heat exchanger comprises only one intermediate segment, the fluid flow channel of the one intermediate segment and the fluid flow channels of the two end segments are connected in parallel flow connection.

In a preferred embodiment the fluid flow channels in the one or more intermediate segment(s) are provided for counter flow of the liquid to be heated with respect to the flow direction of the flue gas channels.

In a preferred embodiment, observed in the direction perpendicular to the one or more intermediate segment(s), an intermediate segment comprises at least two channels for fluid flow next to each other, preferably arranged in counter flow relation. More preferred is when in an intermediate segment, at least two channels for fluid flow next to each other are located in the heat exchanger towards the flue gas exit of the sectional heat exchanger. It is a benefit of such embodiments that the efficiency of heat transfer is further increased synergistically as the water flow is split and more forced towards the walls of the fluid channels that are in heat exchange relation with the flue gas channel.

A second aspect of the invention is a heat cell, comprising a sectional heat exchanger as in the first aspect of the invention; and a, preferably one, more preferably only one, burner, preferably a premix gas burner, and preferably a cylindrical burner, provided in the combustion chamber for the production of flue gas to flow through the flow channels for flue gas between the segments—in parallel flow connection. The burner is preferably mounted so that it extends in the combustion chamber perpendicularly to the one or more intermediate segment(s).

It is a benefit that one single cylindrical burner can be used for the production of flue gas that will transfer its energy via heat transfer from the channels for flue gas flow in between segments, to the flow channels for fluid flow in the segments.

Preferably, the heat cell has a condensation sump at the bottom of the heat cell.

DETAILED DESCRIPTION OF THE INVENTION

Figure 1:
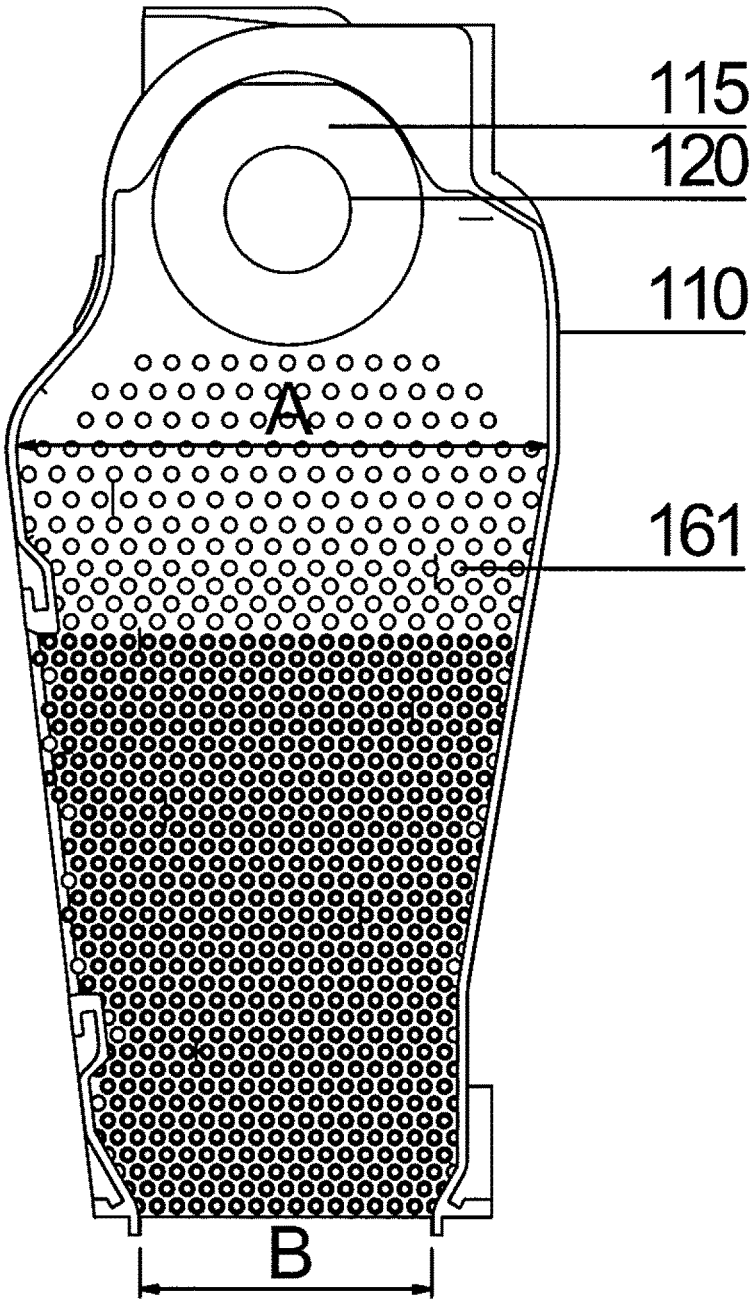
FIG. 1 shows a cross section in between two segments, perpendicularly to the combustion chamber, of a sectional heat exchanger according to the invention.
Figure 2:
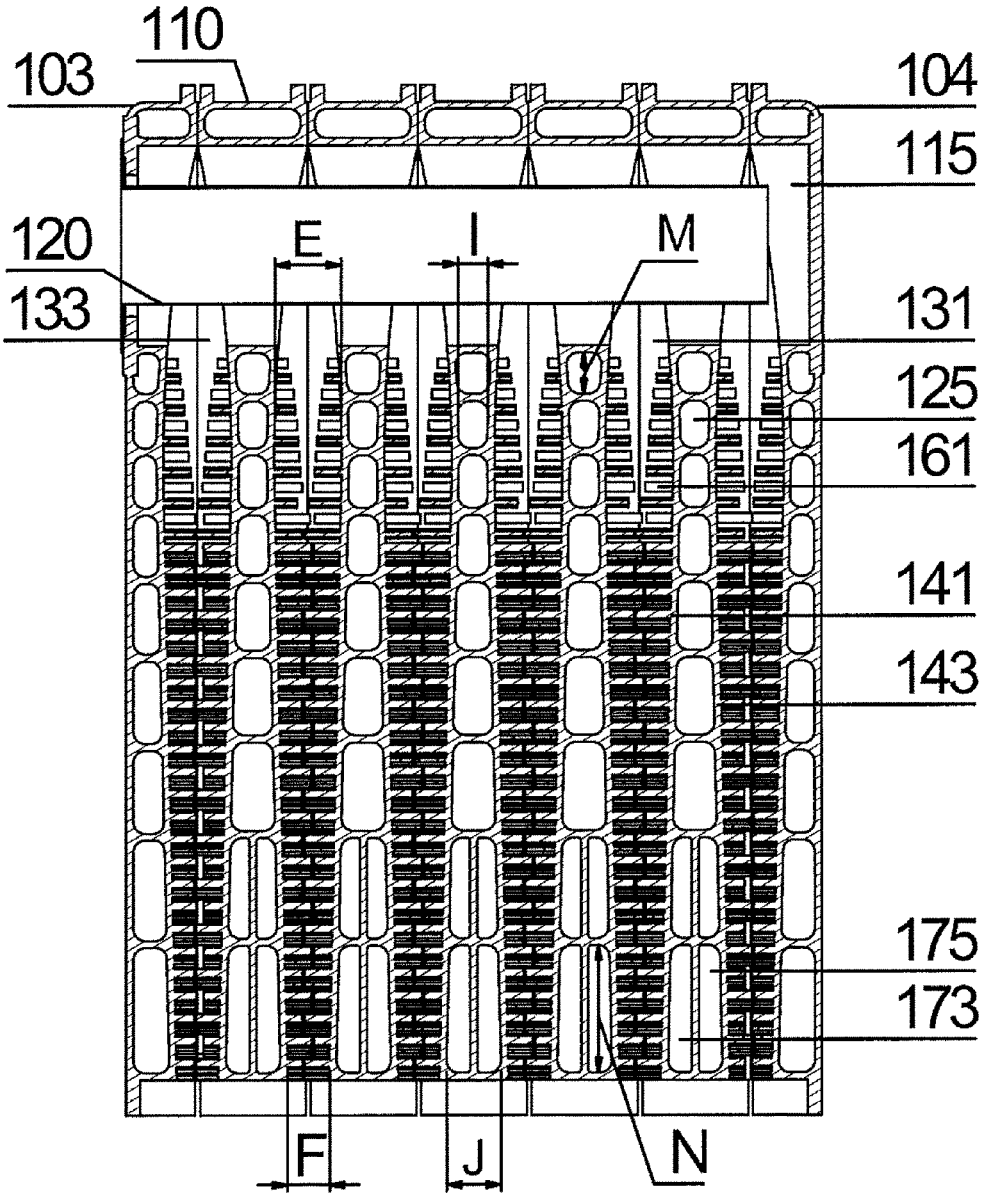
FIG. 2 shows a cross section in the longitudinal direction of the combustion chamber of a sectional heat exchanger according to the invention.
Figure 3:
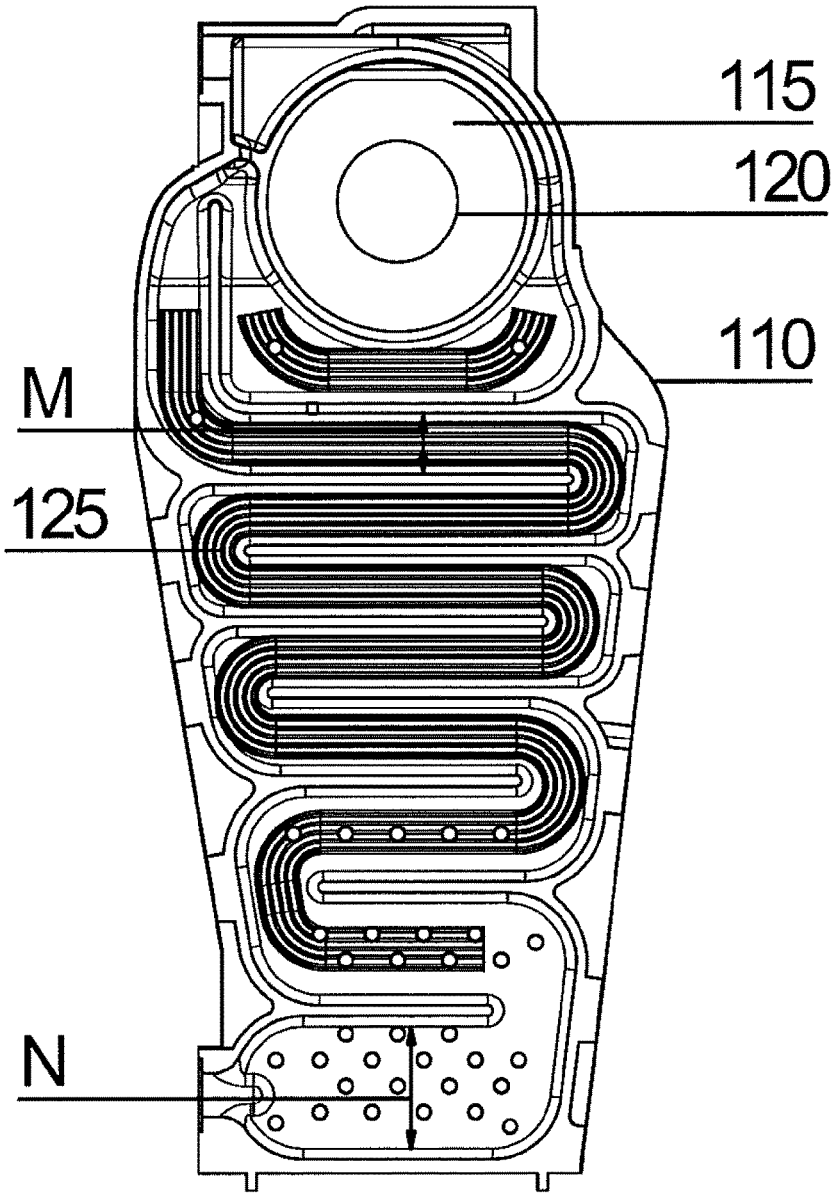
FIG. 3 shows a cross section in an intermediate segment, perpendicularly to the combustion chamber, of a sectional heat exchanger according to the invention.

FIGS. 1-3 show cross sections of a sectional heat exchanger as in the invention. FIG. 1 shows a cross section in between two segments, perpendicularly to the combustion chamber, of a sectional heat exchanger according to the invention. FIG. 2 shows a cross section in the longitudinal direction of the combustion chamber of a sectional heat exchanger according to the invention. FIG. 3 shows a cross section in an intermediate segment, perpendicularly to the combustion chamber of a sectional heat exchanger according to the invention.

The sectional heat exchanger comprises two end segments 103, 104 and one or more intermediate segment(s) 110 (e.g. five intermediate segments in FIG. 2) provided between the two end segments 103, 104. The one or more intermediate segment(s) 110 and the two end segments 103, 104 are assembled in the heat exchanger, wherein a combustion chamber 115 is provided in the sectional heat exchanger, perpendicular to the one or more intermediate segment(s) 110.

A burner, e.g. a cylindrical premix burner 120 can be installed in the combustion chamber 115, forming a heat cell comprising the sectional heat exchanger and the burner 120. In the preferred embodiment, a burner is used with a straight longitudinal axis aligned with the straight longitudinal axis of the combustion chamber 115. Preferably, only one burner 120 is provided in the combustion chamber 115.

Each of the one or more intermediate segment(s) 110 comprises at least one flow channel 125 for a fluid to be heated. In between each two consecutive segments (end segments 103, 104 or intermediate segments 110) at least one flow channel 131, 133 for flue gas is present, wherein the flow channel extends from at the combustion chamber 115, allowing flue gas generated in the combustion chamber 115 by a burner 120 to flow from the combustion chamber 120 through the flow channels 131, 133 for flue gas.

In between two segments, in the plane parallel with the one or more intermediate segment(s), the total width of the sectional heat exchanger decreases over at least part of the length in the direction away from the combustion chamber. This is illustrated in FIG. 1 by the ratio between width A and width B, width A and width B being the total width of the sectional heat exchanger, here also the width available for flue gas to flow, where the width is maximum (A) and where the width is minimum (B). In the example shown in FIG. 1, the ratio A/B is 1.92. The change in width can be continuous, as is illustrated in the example shown in FIG. 1.

The depth of the flow channels 131, 133 for flue gas, measured perpendicularly to the one or more intermediate segments 110 and between consecutive segments, decreases in the direction away from the combustion chamber. This is illustrated in FIG. 2 with depth E at the start of the flue gas channel 131 and depth F at the end of the flue gas channel 131. In the example, the depth is continuously decreasing from the start of the flue gas channel 131 in heat exchange contact with fluid flow channel 125 till the end of the flue gas channel 131. As an example, the ratio between the largest depth E and the smallest depth F is 3.06.

In the one or more intermediate segment(s) 110, the distance I, J between the two walls 141, 143 delimiting the intermediate segment 110 and which are in heat exchanging relation with flue gas channels 131 formed between segments, increases in the direction away from the combustion chamber 115, thereby increasing the depth available for one or more fluid flow channels 125 in the intermediate segment 110. In the example of the invention as shown in FIG. 1, the increase is a continuous increase.

In the example as shown in the figures, the ratio of the maximum to the minimum surface of the cross section of a flue gas channel—measured perpendicularly to the one or more intermediate segment(s)—in a same flue gas channel between consecutive segments equals (A*E)/(B*F), or for the example 5.87.

The walls 141, 143 of the intermediate segments 110 and of the end segments 103, 104 between the at least one channel for fluid to be heated 125 and the flow channel for flue gas 131, 133 can be provided with means, e.g. pins 161 extending from the walls 141, 143 into the flue gas channel 131, 133 to increase the heat transfer through the walls.

In the examples shown in the figures, a fluid flow channel 125 in an intermediate segment 110 follows a meandering flow path. Preferably the meandering flow channels are substantially perpendicular to the direction of flue gas flow in the flue gas channels 131, 133 between segments 103, 104, 110.

In the example, the height M, N of at least part of the fluid flow channels in the end segments and in the intermediate segment(s) increases in the direction away from the combustion chamber.

In the example, the fluid flow channels 125 of the end segments 103, 104 and of the intermediate segments 110 are connected in parallel flow connection with each other.

In the example, the fluid flow channels in the one or more intermediate segment(s) 110 are provided for counter flow of the liquid to be heated with respect to the flow direction of the flue gas channels 131.

In the example, observed in the direction perpendicular to the one or more intermediate segment(s) 110, an intermediate segment 110 comprises at least two channels 173, 175 for fluid flow next to each other, preferably arranged in counter flow relation, although a flow in the same flow direction is also possible.

The heat exchanger of the invention has shown to have excellent energy efficiency and it can be made light and compact.

The invention claimed is:

1. A sectional heat exchanger for a heat cell, wherein said sectional heat exchanger comprises two end segments and one or more intermediate segment(s) provided between said two end segments;

said one or more intermediate segment(s) and said two end segments are assembled in said heat exchanger, wherein a combustion chamber is provided in said sectional heat exchanger, perpendicular to said one or more intermediate segment(s), each of said one or more intermediate segments comprises at least one flow channel for a fluid to be heated, in between each two consecutive segments at least one flow channel for flue gas is present, and said flow channel extends from said combustion chamber, wherein in between two segments, in a plane parallel with said one or more intermediate segment, a total width of the sectional heat exchanger decreases over at least half of a length in a direction away from said combustion chamber;

a depth of said flow channels for flue gas, measured perpendicularly to said one or more intermediate segment(s) and between consecutive segments, decreases in the direction away from said combustion chamber, in said one or more intermediate segment(s), a distance between two walls delimiting said intermediate segment and which are in heat exchanging relation with flue gas channels between segments, increases in the direction away from said combustion chamber, thereby increasing a depth available for one or more fluid flow channels in said intermediate segment.

2. The sectional heat exchanger of claim 1, comprising at least two intermediate segments and wherein said at least two intermediate segments are provided parallel to each other in said sectional heat exchanger.

3. The sectional heat exchanger of claim 1, wherein the ratio of the maximum to the minimum surface of the cross section of a flue gas channel—measured perpendicularly to the one or more intermediate segment(s)—in a same flue gas channel between consecutive segments is between 4 and 6.

4. The sectional heat exchanger of claim 1, wherein at least part of the walls of said one or more intermediate segment(s) between the at least one channel for fluid to be heated and said flow channel for flue gas are provided with means to increase the heat transfer through said walls.

5. The sectional heat exchanger of claim 1, wherein in said intermediate segment, a fluid flow channel follows a meandering flow path.

6. The sectional heat exchanger of claim 1, wherein the height of at least part of the fluid flow channels in said intermediate segment increases in the direction away from said combustion chamber.

7. The sectional heat exchanger of claim 1, wherein the sectional heat exchanger comprises more than one intermediate segment and wherein fluid flow channels of the more than one intermediate segments are connected in parallel flow connection.

8. The sectional heat exchanger of claim 1, wherein said fluid flow channels in said one or more intermediate segment(s) are provided for counter flow of said liquid with respect to the flow direction of said flue gas channels.

9. The sectional heat exchanger of claim 1, wherein observed in the direction perpendicular to said one or more intermediate segment(s), an intermediate segment comprises at least two channels for fluid flow next to each other.

10. A heat cell, comprising a sectional heat exchanger as in claim 1; and a burner, provided in said combustion chamber for the production of flue gas to flow in parallel through said flow channels for flue gas between said segments.

11. The heat cell of claim 10, wherein said burner is extending perpendicularly to the one or more intermediate segment(s).

12. A heat cell comprising a sectional heat exchanger and a premix gas burner;

wherein said sectional heat exchanger comprises two end segments and one or more intermediate segment(s) provided between said two end segments;

said one or more intermediate segment(s) and said two end segments are assembled in said heat exchanger, wherein a combustion chamber is provided in said sectional heat exchanger, perpendicular to said one or more intermediate segment(s), each of said one or more intermediate segments comprises at least one flow channel for a fluid to be heated, in between each two consecutive segments at least one flow channel for flue gas is present, and said flow channel extends from said combustion chamber, wherein in between two segments, in a plane parallel with said one or more intermediate segment, a total width of the sectional heat exchanger decreases over at least half of a length in a direction away from said combustion chamber;

a depth of said flow channels for flue gas, measured perpendicularly to said one or more intermediate segment(s) and between consecutive segments, decreases in the direction away from said combustion chamber, in said one or more intermediate segment(s), a distance between two walls delimiting said intermediate segment and which are in heat exchanging relation with flue gas channels between segments, increases in the direction away from said combustion chamber, thereby increasing a depth available for one or more fluid flow channels in said intermediate segment;

wherein the combustion chamber is beam shaped with a straight linear axis through the one or more intermediate segments, wherein the combustion chamber has a constant cross section through the intermediate segment(s) of the sectional heat exchanger, wherein said premix gas burner is provided in said combustion chamber having a straight longitudinal axis aligned with the straight linear axis of the combustion chamber configured to produce flue gas to flow in parallel through said flow channels for flue gas between said segments;

and wherein the premix gas burner extends through circular openings in one of the end segments and through the one or more intermediate segments.

* * * * *